United States Patent [19]

Linneweh et al.

[11] 3,994,333

[45] Nov. 30, 1976

[54] CORE BLOWING MACHINE

[75] Inventors: Kurt Linneweh; Reiner Rommel, both of Mannheim, Germany

[73] Assignee: Adolf Hottinger, Mannheim, Germany

[22] Filed: Aug. 5, 1975

[21] Appl. No.: 601,982

[30] Foreign Application Priority Data

Sept. 17, 1974 Germany ..... 2444332

[52] U.S. Cl. ..... 164/157; 164/181; 164/186; 164/228; 164/269

[51] Int. Cl.[2] ..... B22C 13/12; B22C 17/10

[58] Field of Search ..... 164/154, 165, 166, 180, 164/183–186, 190, 212–214, 224, 228, 269, 344, 347, 157

[56] References Cited

UNITED STATES PATENTS

| | | | |
|---|---|---|---|
| 1,720,357 | 7/1929 | Willard | 164/347 X |
| 2,733,490 | 2/1956 | Yates et al. | 164/344 |
| 2,852,818 | 9/1958 | Shallenberger et al. | 164/165 |
| 3,049,767 | 8/1962 | Guyot | 164/269 X |

*Primary Examiner*—Leonidas Vlachos
*Attorney, Agent, or Firm*—Hans Berman

[57] ABSTRACT

The two halves of the core box in a core blowing machine are mounted on a carrier which may be turned 180° between a blowing position in which sand is blown into the closed core box and a discharging position in which the core box halves are separated in the direction of the axis of rotation and the molded core is ejected. A transfer receptacle moves into the discharging zone between the separated core box halves to receive the ejected core and to withdraw it from the discharging zone while the core box is again being closed and simultaneously turned with the carrier into the blowing position.

7 Claims, 4 Drawing Figures

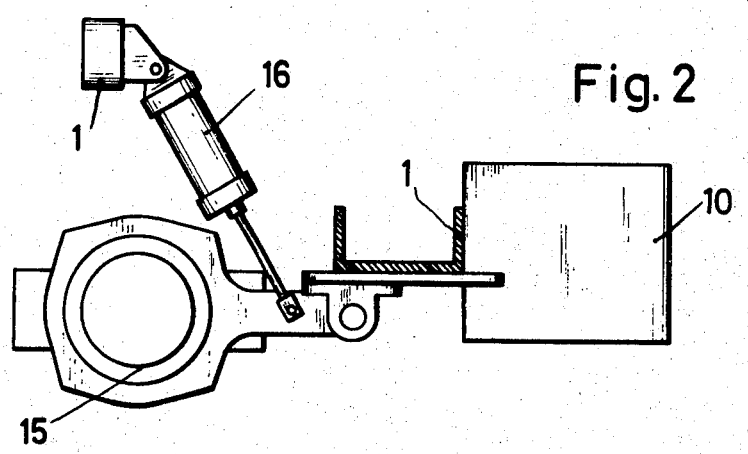
Fig. 2
Fig. 3
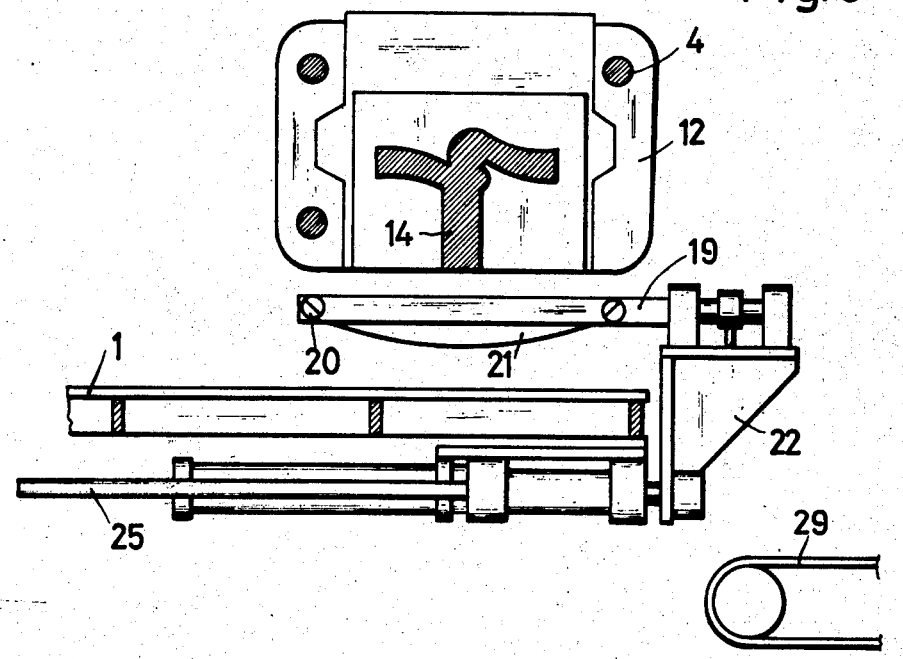

CORE BLOWING MACHINE

This invention relates to core blowing machines, and particularly to an improved discharge arrangement for the molded core.

In order to obtain maximum output from an automatic core blowing machine, it is customary to eject molded cores from the core box before they have reached their ultimate mechanical strength. When the molded cores drop from the opened core box, they may break. Attempts have been made to reduce breakage of ejected cores by modification of the core blowing machine, but the known modifications, when effective for reducing breakage, significantly lengthen the core molding cycle and thereby reduce output.

It is a primary object of this invention to provide a core blowing machine from which even delicate cores may safely be ejected without damage, the output of the machine being unaffected by the measures taken for protecting the newly molded cores.

With this object and others in view, as will hereinafter become apparent, the invention provides a core blowing machine in which a core box carrier is mounted on a support for angular movement about an axis between a blowing position and a discharge position. First and second core box portions are mounted on the carrier for movement by a first moving device between an open position and a closed position. In the closed position, the two core box portions are contiguously juxtaposed and jointly constitute a core box formed with a cavity and with a conduit leading outward of the cavity to an orifice in the outer core box surface. Respective parts of the first core box portion bound the cavity, the conduit, and the orifice in the closed position. In the open position, the core box portions are axially remote from each other and axially bound a discharging zone therebetween.

A second moving device moves the core box carrier between its blowing and discharging positions. A conventional sand blowing apparatus fills the cavity and the conduit with particulate core sand mixture by blowing the mixture into the core box orifice in the closed position of the core box portions while the carrier is in the blowing position. The core formed in the cavity is ejected from the first core box portion into the discharging zone between the open core box portions while the carrier is in the discharging position. A third moving device moves a transfer receptacle inward and outward of the discharging zone transversely to the axis of angular carrier movement. The part of the first core box portion which bounds the core box orifice is angularly adjacent the transfer receptacle in the discharging position and remote from the receptacle in the blowing position. A central control mechanism is operatively connected to the several moving devices, the sand blowing apparatus, and the ejection mechanism for operating the same in timed sequence, more specifically, for operating the first and third moving devices in such a manner that the receptacle is being moved inward of the discharging zone while the core box portions are being moved toward the open position and for moving the receptacle outward of the discharging zone while the core box portions are moved toward the closed position.

Other features, additional objects, and many of the attendant advantages of this invention will readily become apparent as the same is better understood from the following detailed description of a preferred embodiment when considered in connection with the appended drawing in which:

FIG. 2 illustrates elements of the machine of FIG. 1 in top plan view and partly in section on the line II — II;

FIG. 3 shows the machine in fragmentary side elevation and partly in section on the line III — III in FIG. 1.

Figure 1:
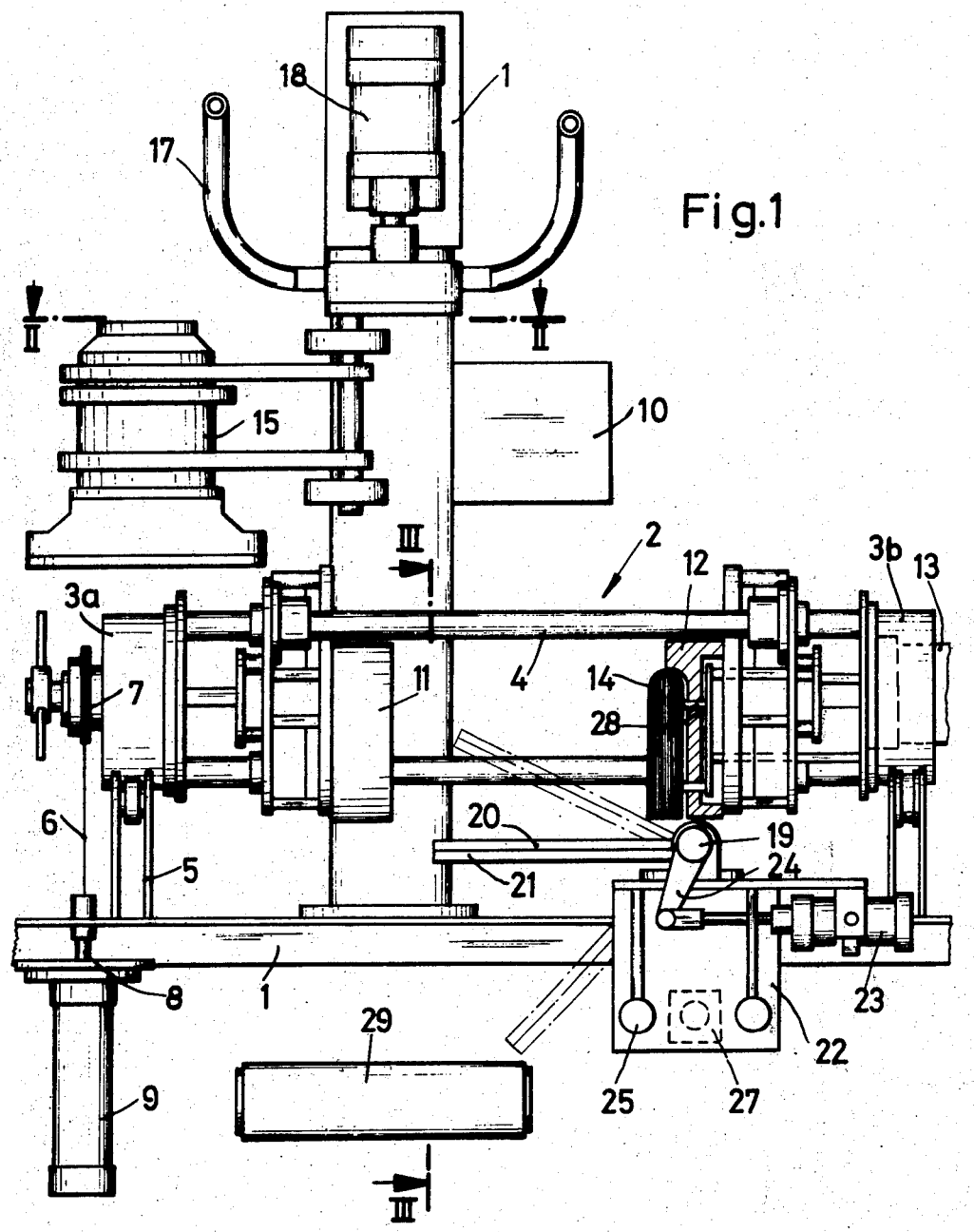
FIG. 1 shows a core blowing machine of the invention in front elevation, and partly in section.

Referring now to the drawing in detail, and initially to FIG. 1, there is shown only as much of the stationary supporting base 1 of a core blowing machine as is needed for an understanding of the invention, all movable elements of the machine being mounted on the base 1. These elements include a core box carrier 2 which includes two coaxial discs 3*a*,3*b* and three cylindrical rods 4 connecting respective, opposite, circular faces of the discs so as to define three corners of a rectangle on each disc face. The discs 3*a*,3*b* and three cylindrical rods 4 connecting respective, opposite, circular faces of the discs so as to define three corners of a rectangle on each disc face. The discs3*a*,3*b* are supported on the base 1 by means of bearings 5 for rotation about their common axis which is approximately horizontal in the illustrated operative condition of the machine. A chain 6 is trained over a sprocket 7 coaxially attached to the disc 3*a*, and the ends of the chain are fastened to respective piston rods 8 of two hydraulic cylinders 9.

Electromagnetic valves in the hydraulic circuit of the cylinders 9 and a timing switch operating the valves are concealed in a control box 10, and the valves are energized by the switch from time to time to return the carrier 180° about its horizontal axis, as will presently be described. The pressure lines connecting the cylinders 9 to the valves in the control box 10, and the positive displacement pump feeding hydraulic fluid to the valves have not been shown in order not to crowd the drawing since they are conventional in themselves. The several other hydraulic cylinders referred to hereinbelow are similarly controlled by respective valves or sets of valves in the box 10, all valves being energized in the necessary sequence by the non-illustrated timing switch.

The two halves 11, 12 of a core box are mounted on the three rods 4. The core box half 11 is axially fixed on the carrier 2 near the disc 3*a* while the core box half 12 may be moved axially by a hydraulic cylinder 13 on the disc 3*b* between the illustrated open position and a closed position of abutting engagement with the box half 11 in which the two halves jointly bound a mold cavity. The shape of the cavity is evident from a sand core 14 formed in the mold and shown in FIGS. 1 and 3. The mold cavity communicates with an elongated conduit leading to an orifice in the outer surface of the closed core box in a direction approximately radial relative to the axis of rotation of the core box carrier 2. The carrier is turned by the cylinders 9 between the illustrated discharging position and a blowing position in which the core box orifice is upwardly directed and is located above the rods 4 and the enlarged portions of the core box halves directly engaged by the rods.

A sand magazine 15 may be swung on the base 1 between the inoperative position shown in FIG. 1 and an operative position of vertical alignment with the closed core box by a hydraulic cylinder 16, shown in FIG. 2. Compressed air is supplied by hoses 17 controlled by valves in the box 10 to the top of the sand magazine 15 in the operative position and blows sand from a blowhole in the bottom of the magazine into the mold cavity, tight sealing engagement between the magazine, its air supply, and the mold being maintained by a hydraulic cylinder 18 during the blowing operation, as is conventional in itself. The sand may contain a polymerizable organic binder, and the blowing air may contain a catalyst for initiating polymerization of the binder so that the granular material blown into the mold is converted quickly to a shape retaining, coherent body. The cylinders 18, 16, 9, and 13 are actuated during hardening of the freshly molded core to release the sand magazine from the core mold and swing it into its inoperative position, to turn the core box carrier 180° into the illustrated position, and to retract the core box portion 12 from the stationary core box half 11.

When the condition of the apparatus shown in FIG. 1 is reached, ejector pins 28 axially slidable in bores of the core box portion 12 are engaged by the disc **3*b* and pushed against the core 14. The core is released from the core box half 11 and travels with the core box half 12 during the opening movement of the latter because of minor differences in the configuration of the core box portions. When the cylinder 13 further retracts the core box half 12 from the position of FIG. 1 toward the disc 3*b*, the pins 28 eject the molded core 14 into a transfer receptacle mainly consisting of a shaft 19, two radial arms 20 projecting from the shaft, and a sheet 21** of asbestos cloth or silicone rubber.

Figure 4:
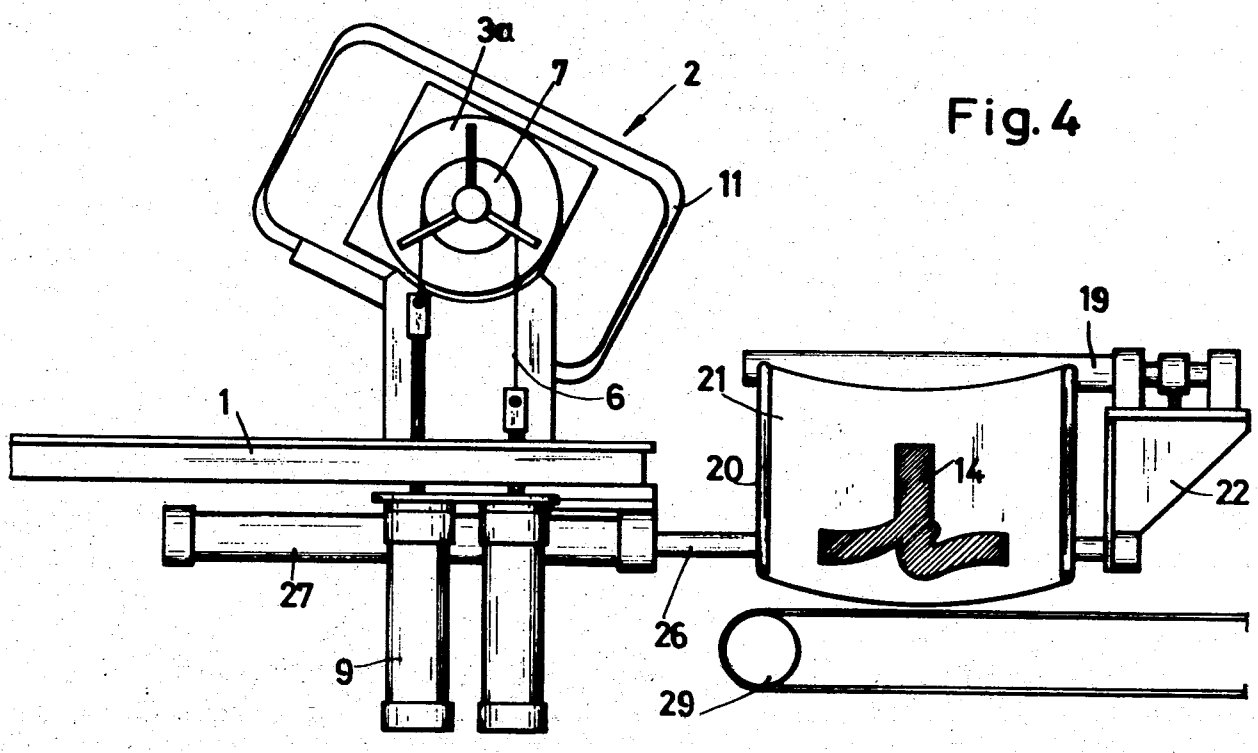
FIG. 4 illustrates the device of FIG. 3 in side elevation in another operative position.

As is best seen in FIGS. 3 and 4, one end of each arm 20 is mounted in the shaft 19 by a tight friction fit. Two opposite edges of the sheet 21 are fastened to the arms 20, and slots in the ends of the arms 20 may be engaged by a screw driver for turning the arms and for thereby varying the tension in the sheet 21.

The shaft 19 is pivotally mounted on a bracket 22 which also carries a hydraulic cylinder 23. A crank 24 on the shaft 19 may be turned by the cylinder 23 to swing the receptacle through an arc adjustable to a range of approximately 90° between two positions indicated in phantom view in FIG. 1, in which the arms 20 slope upwardly and downwardly respectively from the shaft 19. The bracket 22 carries guide rods 25 slidably received in the base 1, and the piston rod 26 of a hydraulic cylinder 27 mounted on the base 1 is attached to the bracket 22 for moving the latter with the receptacle supported thereon transversely of the rods 4 between positions indicated respectively in FIGS. 3 and 4.

As shown in FIG. 3, the transfer receptacle 19,20,21 is located in the discharging zone between the open core box halves 11,12 ready for receiving the ejected core 14, and the top face of the sheet 21 is approximately parallel to the axis of core carrier rotation and subjacent the carrier. The receptacle is withdrawn from the discharging zone by the cylinder 27 and approximately simultaneously tilted by the cylinder 23 toward the unloading position shown in FIG. 4 so that the core received by the receptacle slides downward and away from the shaft 19 to a belt conveyor 29 which removes the core from the core blowing machine to another stage of the mold making operation.

The location of the orifice in the closed core box is determined by the operative position of the sand magazine 15, and is always the same, regardless of the specific shape and size of the core that it is intended to form. The portion of the core molded in the orifice thus has a fixed vertical location in the discharging position of the core box half 12. If the non-illustrated valves controlling the cylinder 23 are set to swing the transfer receptacle between the fully drawn receiving position shown in FIG. 1 and the downwardly sloping unloading position, the free fall of the ejected core is limited to the vertical distance between the mold orifice in the mold half 12 and the top face of the sheet 21, and can readily be made so small as to avoid any damage to the ejected core even if incompletely cured. If the core is unusually large and heavy so that it may be injured by even a short free fall, the valves in the control box 10 may be set to raise the transfer receptacle to the position seen in FIG. 1 in which the sheet 21 slopes downward toward the shaft 19, and is even nearer the core at the moment of ejection than in the fully drawn position.

In an actual embodiment of the illustrated core blowing machine, the valves in the control box 10 were timed in such a manner that the core box half 12 moved back and forth almost continuously with a minimal dwell time at the points of reversal. The closed position of the core box was maintained merely long enough for sand injection and for partial curing of the binder in the core sand, and the dwell time in the fully open position of the mold was even shorter. During the opening stroke of the core box half 12, the core box carrier 2 was turned from the non-illustrated blowing position into the illustrated discharging position. Simultaneously, the transfer receptacle was raised from the unloading position seen in FIG. 4 and moved inward of the discharging zone which opened between the core box halves. The sand magazine 15 was swung by the cylinder 16 into the illustrated inoperative position at the beginning of the mold opening stroke and was replenished with core sand in a conventional manner, not shown, while the core box was open.

As soon as the molded core 14 was ejected, the core box carrier 2 started turning, and the transfer receptacle moved out of the discharging zone so as not to interfere with core box closing. The same magazine 15 was firmly seated on the core box as soon as the latter was closed and ready to receive the injected sand.

The specific illustrated structure of the transfer receptacle has been found to reduce breakage of ejected cores to a negligible amount. The rigid frame of the receptacle, constituted by the shaft 19 and the arms 20 maintains a precisely determined minimal distance between the orifice of the core box cavity on the box half 12 and the receptacle, and the pliable, resilient material of the sheet 21 damps the impact of the falling core 14.

The output of the machine is limited solely by the time required for preliminary curing of the core sand and for opening and closing the core box. The removal of the molded core from the box occurs simultaneously with these steps and does not lengthen the operating cycle.

The invention has been described with reference to a core material which is cured by exothermic polymerization of a catalyzed organic resin binder, and the material for the sheet 21 was chosen accordingly. The invention, however, is not limited to the specific curing mechanism of the particulate material blown into the core box, and the unloading mechanism of the invention is used to advantage with any known system of solidifying the particulate core material.

It should be understood, therefore, that the foregoing disclosure relates only to a preferred embodiment, and that it is intended to cover all changes and modifications of the example of the invention herein chosen for the purpose of the disclosure which do not constitute departures from the spirit and scope of the invention set forth in the appended claims.

What is claimed is:

1. A core blowing machine comprising:

a. a support;

b. a core box carrier mounted on said support for angular movement about an axis between a blowing position and a discharging position, said axis extending horizontally in the normal operating position of said machine;

c. a first core box portion and a second core box portion mounted on said carrier;

d. first moving means for moving one of said portions in the direction of said axis relative to the other portion between an open position and a closed position, 1, said portions in said closed position being contiguously juxtaposed and jointly constituting a core box formed with a cavity and with a conduit leading outward of said cavity to an orifice in the outer surface of said core box, 2. respective parts of said first core box portion bounding said cavity, said conduit, and said orifice in said closed position, 3. said core box portions being axially remote from each other and axially bounding a discharging zone therebetween in said open position;

e. second moving means for moving said carrier between said blowing position and said discharging position;

f. sand blowing means for filling said cavity and said conduit with particulate core material by blowing said material into said orifice while said core box portions are in the closed position, and said carrier is in the blowing position, whereby a core is formed from said material in said cavity and in said conduit;

g. ejecting means for ejecting the formed core from said first core box portion into said discharging zone while said core box portions are in said open position and said carrier is in said discharging position;

h. a transfer receptacle movably mounted on said support, 1. said receptacle including a frame and a flexible sheet member mounted on said frame;

i. third moving means for moving said receptacle inward and outward of said discharging zone transversely to said axis between a receiving position and an unloading position, 1. a face of said sheet member being substantially parallel to said axis and subjacent said carrier in said receiving position, 2. said face in said unloading position sloping downward away from said axis from said first core box member toward said second core box member, 3. whereby a core ejected from said first core box member drops on said face of the receptacle, and slides downward on said face in said unloading position, 4. the part of said first core box portion bounding said orifice being angularly adjacent said receptacle in said discharging position and remote from said receptacle in said blowing position; and k. control means operatively connected to said first, second and third moving means, said blowing means, and said ejecting means for operating the same in timed sequence, 1. said control means operating said first and third moving means for moving said receptacle inward of said discharging zone while said one core box portion is moved toward the open position, and for moving said receptacle outward of said discharging zone while said one core box portion is moved toward the closed position.

2. A machine as set forth in claim 1, further comprising conveying means for receiving said ejected core from said receptacle after said downward sliding, and for conveying the received core away from said discharging zone.

3. A machine as set forth in claim 1, wherein said frame is more rigid than said sheet member, the receptacle further including means for tensioning said sheet member.

4. A machine as set forth in claim 1, wherein said frame is mounted on said support for pivoting movement by said third moving means about a pivot axis transverse to said axis of angular carrier movement.

5. A machine as set forth in claim 4, wherein said third moving means include means for lifting said receptacle into a position in which said face extends obliquely upwardly from said pivot axis into said discharging zone and toward said second core box portion.

6. A machine as set forth in claim 1, wherein said blowing position and said discharging position are offset from said axis in opposite directions.

7. A machine as set forth in claim 6, wherein said second moving means are operated by said control means for turning said carrier through approximately one half of a revolution about said axis between said blowing and discharging positions.

* * * * *